US008074370B1

(12) United States Patent
Monahan et al.

(10) Patent No.: US 8,074,370 B1
(45) Date of Patent: Dec. 13, 2011

(54) HORIZONTAL CENTRIFUGAL DEVICE FOR MOISTURE REMOVAL FROM A RUG

(76) Inventors: Thomas Monahan, Ann Arbor, MI (US); Greg Turcotte, Black Diamond (CA)

( * ) Notice: Subject to any disclaimer, the term of this patent is extended or adjusted under 35 U.S.C. 154(b) by 550 days.

(21) Appl. No.: 12/290,101

(22) Filed: Oct. 27, 2008

Related U.S. Application Data

(60) Provisional application No. 61/002,333, filed on Nov. 8, 2007.

(51) Int. Cl.
*F26B 17/24* (2006.01)

(52) U.S. Cl. ..... 34/58; 34/90; 15/321; 166/77.53

(58) Field of Classification Search ..... 34/58, 59, 34/78, 80, 90, 210, 218, 242, 60; 15/321, 15/50.3; 166/77.53
See application file for complete search history.

(56) References Cited

U.S. PATENT DOCUMENTS

| | | | | | |
|---|---|---|---|---|---|
| 1,339,784 | A | * | 5/1920 | Osborne | 34/239 |
| 1,455,755 | A | * | 5/1923 | Allsop et al. | 34/636 |
| 1,741,755 | A | * | 12/1929 | Chase et al. | 34/70 |
| 1,775,130 | A | * | 9/1930 | Klein | 34/627 |
| 2,104,173 | A | * | 1/1938 | Sibson | 34/627 |
| 2,236,430 | A | * | 3/1941 | Hurxthal | 34/70 |
| 2,265,071 | A | * | 12/1941 | Hartenbach, Jr. | 34/464 |
| 2,270,031 | A | * | 1/1942 | Biby et al. | 34/307 |
| 2,505,041 | A | * | 4/1950 | Gorsuch | 34/527 |
| 2,649,279 | A | * | 8/1953 | Jones et al. | 254/329 |
| 2,712,683 | A | * | 7/1955 | Gaunt et al. | 28/159 |
| 2,783,868 | A | * | 3/1957 | Myers | 198/681 |
| 2,794,265 | A | * | 6/1957 | Kruger | 34/58 |
| 2,884,709 | A | * | 5/1959 | Kruger | 34/58 |
| 2,912,769 | A | * | 11/1959 | Kruger | 34/58 |
| 3,013,901 | A | * | 12/1961 | Bugosh | 442/136 |
| 3,088,221 | A | * | 5/1963 | Pansing et al. | 34/527 |
| 3,132,004 | A | * | 5/1964 | Horecky | 34/549 |
| 3,286,368 | A | * | 11/1966 | Thomas | 34/618 |

(Continued)

FOREIGN PATENT DOCUMENTS

GB 2304550 A * 3/1997

(Continued)

OTHER PUBLICATIONS fornivarese.com web site, ? Jan. 18, 2009? Fomi Varese Company, p. 2-3.

*Primary Examiner* — Stephen M. Gravini
(74) *Attorney, Agent, or Firm* — Barbara M. Burns

(57) ABSTRACT

A device for removing moisture from a rug or other item, such as a tent or a tarp, etc. in a short time while preventing compression of the rug or the item and the resultant crushing of fringe comprising a shaft disposed on a horizontal axis having a large diameter with a rotatable smaller diameter inner tube therein, the smaller diameter inner tube having apertures therethrough, the smaller diameter inner tube being open at both ends, the inner tube being driven to rotate, and fluid removal means connected to the larger diameter tube for removal of fluid from the device, whereby when a wet rug is loaded into the smaller diameter inner tube, and rotated the moisture in the rug is spun from the rug through the apertures into the larger diameter outer tube and the moisture is drained from the device. A wet item can be loaded from either end and the item can be unloaded from either end after the moisture has been removed.

8 Claims, 2 Drawing Sheets

U.S. PATENT DOCUMENTS 3,362,087 A * 1/1968 Brock ..... 34/646
3,425,137 A * 2/1969 Lambert ..... 34/92
3,589,147 A * 6/1971 Price et al. ..... 68/125
3,629,953 A * 12/1971 Fleming ..... 34/646
3,641,681 A * 2/1972 Brock ..... 34/273
3,644,079 A * 2/1972 Smith et al. ..... 8/492
3,739,483 A * 6/1973 Meier-Windhorst ..... 26/92
3,743,474 A * 7/1973 Brock ..... 26/92
3,747,155 A * 7/1973 Koellisch ..... 15/322
3,806,310 A * 4/1974 Brock ..... 432/59
3,923,449 A * 12/1975 Brock ..... 432/59
3,955,287 A * 5/1976 Brock et al. ..... 34/636
3,963,432 A * 6/1976 Hauxwell et al. ..... 8/609
3,964,925 A * 6/1976 Burgoon ..... 134/21
3,974,310 A * 8/1976 Mischutin ..... 427/393.3
3,991,482 A * 11/1976 Brock et al. ..... 34/552
4,005,979 A * 2/1977 Brock ..... 432/8
4,016,019 A * 4/1977 Norris ..... 156/64
4,019,218 A * 4/1977 Cyphert ..... 15/321
4,120,798 A * 10/1978 Mischutin ..... 252/604
4,137,648 A * 2/1979 Rhodes ..... 34/86
4,145,821 A * 3/1979 Schantz ..... 34/237
4,158,077 A * 6/1979 Mischutin ..... 427/381
4,200,994 A * 5/1980 Mellor ..... 34/646
4,261,759 A * 4/1981 Cawley ..... 134/6
4,263,362 A * 4/1981 Straka ..... 442/187
4,348,306 A * 9/1982 Mischutin ..... 252/608
4,348,817 A * 9/1982 Bradshaw ..... 34/75
4,415,331 A * 11/1983 Dusenbury et al. ..... 8/114.6
4,574,413 A * 3/1986 Otting et al. ..... 8/149.1
4,623,583 A * 11/1986 Mischutin ..... 442/146
5,048,202 A * 9/1991 Shero ..... 34/618
5,074,883 A * 12/1991 Wang ..... 8/115.6
5,174,048 A * 12/1992 Shero ..... 34/444
5,219,620 A * 6/1993 Potter et al. ..... 427/434.2
5,257,467 A * 11/1993 White ..... 34/618
5,366,161 A * 11/1994 Potter et al. ..... 239/455
5,520,962 A * 5/1996 Jones, Jr. ..... 427/393.4
5,528,787 A * 6/1996 Cutler ..... 15/50.1
5,588,221 A * 12/1996 Hoeltke et al. ..... 34/58
5,659,918 A * 8/1997 Anthony et al. ..... 15/320
5,797,197 A * 8/1998 Alday ..... 34/618
5,813,086 A * 9/1998 Ueno et al. ..... 15/320
5,813,139 A * 9/1998 Lillicotch ..... 34/618
5,836,045 A * 11/1998 Anthony et al. ..... 15/320
5,851,595 A * 12/1998 Jones, Jr. ..... 427/393.4
5,853,814 A * 12/1998 Murphy ..... 427/434.6
5,992,051 A * 11/1999 Salehibakhsh ..... 34/638
6,073,362 A * 6/2000 Dean et al. ..... 34/58
6,088,933 A * 7/2000 Mallalieu ..... 34/328
6,202,322 B1 * 3/2001 Turner, IV ..... 34/618
6,266,892 B1 * 7/2001 Haynie ..... 34/84
6,347,463 B1 * 2/2002 Novak ..... 34/59
6,393,724 B1 * 5/2002 Apple et al. ..... 34/232
6,675,437 B1 * 1/2004 York ..... 15/321
6,739,070 B1 * 5/2004 Jacobs et al. ..... 34/90
6,981,338 B2 * 1/2006 Jensen et al. ..... 34/92
7,007,403 B1 * 3/2006 Studebaker ..... 34/90
7,047,664 B1 * 5/2006 Martinez ..... 34/380
7,179,062 B1 * 2/2007 Drevitson et al. ..... 417/234
7,188,387 B2 * 3/2007 Dicioccio ..... 15/321
7,272,870 B2 * 9/2007 Pierce et al. ..... 15/322
7,779,505 B2 * 8/2010 Krebs et al. ..... 15/339
2003/0182755 A1 * 10/2003 Dicioccio ..... 15/321
2004/0144406 A1 * 7/2004 Garabedian et al. ..... 134/26
2005/0132605 A1 * 6/2005 Jensen et al. ..... 34/618
2005/0246853 A1 * 11/2005 Pierce et al. ..... 15/320
2006/0096116 A1 * 5/2006 Martinez ..... 34/312
2006/0143936 A1 * 7/2006 Studebaker ..... 34/90
2006/0272176 A1 * 12/2006 Elliott et al. ..... 34/523
2007/0051007 A1 * 3/2007 Reets et al. ..... 34/86
2007/0067945 A1 * 3/2007 Kasper et al. ..... 15/353
2007/0089262 A1 * 4/2007 Drevitson et al. ..... 15/339
2007/0119016 A1 * 5/2007 Drevitson et al. ..... 15/339
2008/0190086 A1 * 8/2008 Warren et al. ..... 56/16.4 B
2008/0216278 A1 * 9/2008 Krebs et al. ..... 15/320
2009/0090021 A1 * 4/2009 Huffman et al. ..... 34/359
2009/0133280 A1 * 5/2009 Wichern ..... 34/69
2010/0092765 A1 * 4/2010 Hager et al. ..... 428/331
2010/0098901 A1 * 4/2010 Cowart et al. ..... 428/95
2010/0154146 A1 * 6/2010 Shah et al. ..... 8/552
2011/0028580 A1 * 2/2011 Bergman et al. ..... 521/149

FOREIGN PATENT DOCUMENTS

JP 58096941 A * 6/1983
JP 01280076 A * 11/1989
JP 02004305 A * 1/1990
JP 04210282 A * 7/1992
JP 04210283 A * 7/1992
JP 04241816 A * 8/1992
JP 04281887 A * 10/1992
JP 08024497 A * 1/1996
JP 11255838 A * 9/1999
JP 2000023889 A * 1/2000
JP 2001232318 A * 8/2001
WO WO 2004094717 A1 * 11/2004
WO WO 2009133244 A1 * 11/2009

* cited by examiner

FIG 1
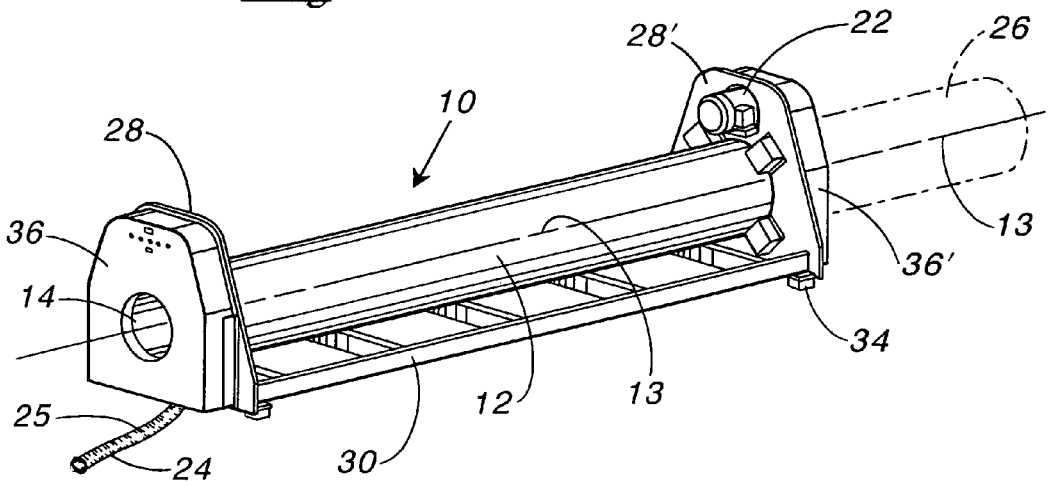
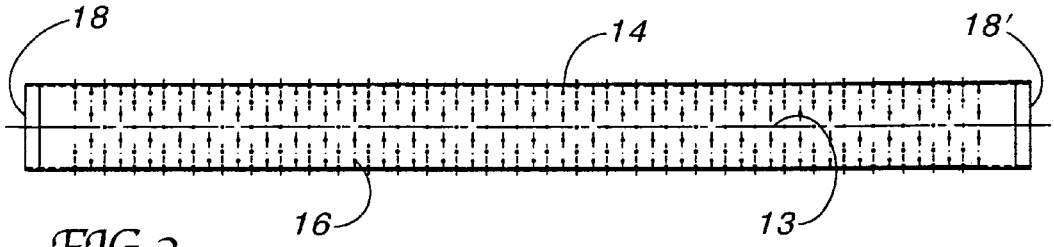
FIG 2
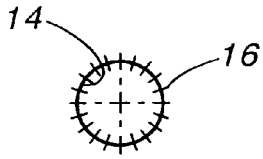
FIG 3

HORIZONTAL CENTRIFUGAL DEVICE FOR MOISTURE REMOVAL FROM A RUG

REFERENCE TO RELATED APPLICATION

This application claims the benefit of provisional patent application No. 61/002,333, filed Nov. 8, 2007.

BACKGROUND OF THE INVENTION

The field of the invention pertains to rugs, such as oriental rugs and area rugs, and, in particular, to a device for removing water from large items, i.e., rugs that are wet from washing.

Compression wringers, mechanical vacuums, and drip drying on poles are techniques that can be used for rugs that are wet from washing.

For example, a wet rug is compressed or squeezed in an attempt to remove moisture from the wet rug. A vacuum can be used to vacuum moisture from the rug as the rug lays flat. The wet rug is suspended on poles to allow the moisture to drip from the rug.

A rug that is still wet is quite heavy and difficult to position on poles. Another problem is that when a wet rug is hung on poles the moisture will drip on the floor and puddle, creating additional humidity as well as potential injury problems from slipping. When a wet rug is vacuumed to remove moisture the underside remains wet and would need to be elevated for drying in order to prevent fungal growth.

Elevating a very wet rug causes unwanted, unremoved soil to gravitate (migrate) to the ends of the vertical drying rug on pole, thus creating an additional step to process the soiled/discolored fringes.

A problem with compressing or squeezing a wet rug is that when a rug is compressed the fringe is also compressed requiring time and effort to straighten the fringe. Moreover, another step of combing/detailing may be required to straighten the fringe. Additionally, the fringe can be damaged if mechanical combing is required.

A need existed for a device that allows the removal of most of the water from a large rug without crushing or compressing the rug or creating discomfort to the operator/person performing the rug cleaning services. A need existed to remove moisture form a wet rug without crushing the rug and hence crushing the fringe of the rug. There existed no dual port device for loading rolled wet rugs. There existed no 14"-20" cylinder driven by a drive system that allows for loading a wet rolled rug.

A need existed for a device to evacuate water quickly (along with soluble soil) out at the closest exit (the pile yarn). This is in contrast to other systems that require water and soil to be squeezed through the entire rug, or water to migrate throughout the length of the rug.

SUMMARY OF THE INVENTION

The invention is a device for removing moisture from a wet rug or other item, such as a tent or a tarp, etc. in a short time while preventing compression of the rug or the item and the resultant crushing of fringe. The invention comprises a shaft having a large diameter with a rotatable smaller diameter inner tube therein, the smaller diameter inner tube having apertures therethrough, the smaller diameter inner tube being open at both ends, the inner tube being driven to rotate, and fluid removal means connected to the larger diameter tube for removal of fluid from the device. The device is horizontal and low to the floor.

When a wet rug is loaded into the smaller diameter inner tube, and rotated the moisture in the rug is spun from the rug through the apertures into the larger diameter outer tube and the moisture is drained from the device. The tube can have an epoxy finish to aid loading and unloading. A wet rug can be loaded from either end and the rug can be unloaded from either end after the moisture has been removed. The dual ports allow for positioning the machine in various locations. The device solves the need for removing moisture from a wet rug or items.

The drive system for rotating the smaller diameter tube employs drive wheels (of compound polymer polyurethane composite), bearings and drive system (motor) to rotate the smaller diameter tube at a high RPM (750-1200 RPMs).

In operation, the wet rug or other item is loaded from either open end of the device into the inner tube of the device. The device is powered and the inner tube starts rotating. As the inner tube rotates with the wet rug therein, the moisture is spun by centrifugal force to the outside of the inner tube. The moisture leaves the inner tube through apertures in the tube. The moisture is forced by centrifugal force into the larger diameter shaft. The larger diameter shaft is sealed but has a drain system for removal of accumulated fluid from within the shaft.

The rotation of the inner tube is caused by a motor driving roller wheels for turning the inner tube. A drive belt connects with the motor with the drive wheels. Roller wheels act as bearings for the inner tube and move the inner tube smoothly. Dynamic braking of the inner tube is caused by stopping the drive motor.

Thus, the wet rug or other item contained within the device has most of the moisture removed from it by being placed in the device and being rotated for a few minutes.

Loading the rug is also facilitated by open ends. Removing the rug from the device is facilitated because open ends allowing pass through of the rug. The horizontal orientation of the device further facilitates loading and removal of the rug or item. A pusher or puller can be employed for loading or unloading the rug or other item.

For a more complete understanding of the present invention, reference is made to the following detailed description when read with in conjunction with the accompanying drawings wherein like reference characters refer to like elements throughout the several views, in which:

BRIEF DESCRIPTION OF THE DRAWINGS

FIG. 1 illustrates an environmental view of the new device for moisture removal from a wet rug;

FIG. 2 illustrates a front view of the inner tube of the new device for moisture removal from a wet rug;

FIG. 3 illustrates a side view of the inner tube of the new device for moisture removal from a wet rug;

DESCRIPTION OF THE PREFERRED EMBODIMENTS

Figure 4:
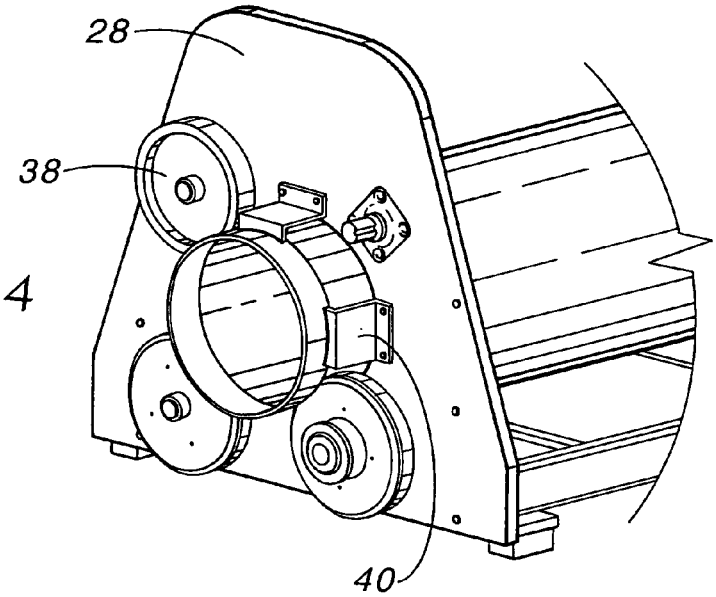
FIG. 4 illustrates the control end of the new device for moisture removal from a wet rug with guard removed.

Illustrated in FIG. 1, new device 10 for removing moisture is thereshown. Device 10 comprises outer shaft 12 having a large diameter and axis 13 with a rotatable smaller diameter inner tube 14 within. Smaller diameter inner tube. 14 has apertures 16 therethrough and open ends 18, 18'. Smaller diameter inner tube 14 being driven to rotate on axis 13 by drive motor 22.

Fluid removal means 24 employing hose 25 connects to larger diameter outer shaft 12 for removal of fluid from device 10. Wet material 26, such as a rug or other item (shown in phantom) can be inserted along axis 13 into inner tube 14 through open end 18, 18'.

Control end bulkhead 28, and drive end bulkhead 28' are at opposite ends of device 10 with support frame 30 connecting between bulkheads 28, 28'. Mount pads 34 are provided on support frame 30.

Control end guard assembly 36 fits on control end bulkhead 28 and drive end guard assembly 36' fits on drive end bulkhead 28'.

Smaller diameter inner tube 14 with apertures 16 is shown in FIG. 2. Side end view of smaller diameter inner tube 14 (FIG. 3) shows apertures 16 through smaller diameter inner tube 14. Smaller diameter inner tube 14 is rotated by drive motor 22 (FIG. 1).

Figure 5:
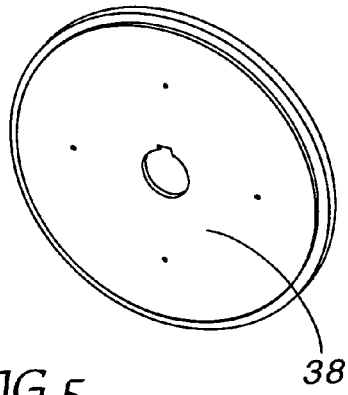
FIG. 5 illustrates a wheel stop ring of the new device for moisture removal from a wet rug.
Figure 6:
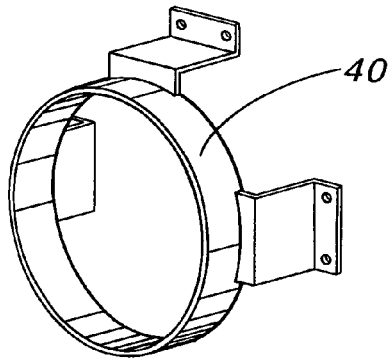
FIG. 6 illustrates stop ring assembly of the new device for moisture removal from a wet rug.

FIG. 4 better shows control end 28 of device 10 with guard 36 removed. FIG. 5 shows wheel stop rings 38. Wheel stop ring assembly 40 is shown in FIG. 6.

Having described the invention, many modifications thereto will become apparent to those skilled in the art to which it pertains without deviation from the spirit of the invention as defined in the appended claims.

The invention claimed is:

1. A device for removing moisture from a wet item while preventing compression of the item and the resultant crushing of fringe on the item, the device comprising a shaft having a large diameter, a rotatable smaller diameter inner tube within the shaft, the smaller diameter inner tube having apertures therethrough and the inner tube being open at both ends, drive means to rotate the inner tube at a high RPM, and fluid removal means connected to the larger diameter tube for removal of fluid from the device, whereby when one of a wet rug and a wet item is loaded into the smaller diameter inner tube, and rotated the moisture in the one of a wet rug and a wet item is spun from the rug through the apertures into the larger diameter outer tube and the moisture is drainable from the device.

2. The device according to claim 1 wherein the drive means for rotating the smaller diameter tube employs bearings and a drive system to rotate the smaller diameter tube.

3. The device according to claim 2 wherein the drive means for rotating the smaller diameter tube employs a motor for rotating the smaller diameter tube at a high RPM.

4. The device according to claim 1 wherein the moisture is drainable from the device through a hose.

5. The device according to claim 1 further comprising a support frame for holding the device.

6. The device according to claim 1 further comprising mount pads.

7. The device according to claim 1 wherein a wet item having moisture in the wet item to be removed, the wet item can be moved into and from the device in one direction through the open ends of the inner tube.

8. A device for removing moisture from a wet item while preventing compression of the item and the resultant crushing of fringe on the item, the device comprising a shaft having a large diameter, the shaft being horizontally disposed, a rotatable smaller diameter inner tube disposed horizontally within the shaft, the smaller diameter inner tube having apertures therethrough and the inner tube being open at both ends, drive means to rotate the inner tube at a high RPM, and fluid removal means connected to the larger diameter tube for removal of fluid from the device, whereby when a wet rug is loaded horizontally into the smaller diameter inner tube, and rotated the moisture in the rug is spun from the rug through the apertures into the larger diameter outer tube and the moisture is drainable from the device.

* * * * *